US005579811A

United States Patent [19]

Hsu

[11] Patent Number: 5,579,811

[45] Date of Patent: Dec. 3, 1996

[54] CONTAINER MODULE FOR DRAWING AND RECEIVING FLUID WASTE

[76] Inventor: Huan-ling Hsu, No. 109, Tienhsiang St., Taichung, Taiwan

[21] Appl. No.: 436,964

[22] Filed: May 8, 1995

[51] Int. Cl.[6] ..... B65B 1/04; B65B 3/04; B67C 3/02

[52] U.S. Cl. ..... 141/98; 141/65; 141/67; 220/592; 220/400; 220/476

[58] Field of Search ..... 141/65, 98, 67; 184/1.5; 220/592, 400, 476

[56] References Cited

U.S. PATENT DOCUMENTS 795,870 8/1905 Voelke ..... 220/592
1,871,522 8/1932 Holmes et al. ..... 184/1.5
4,976,235 12/1990 Commanday ..... 184/1.5
5,074,380 12/1991 Bedi et al. ..... 184/1.5
5,322,092 6/1994 Howeth et al. ..... 141/4

*Primary Examiner*—David J. Walczak
*Assistant Examiner*—Timothy L. Maust
*Attorney, Agent, or Firm*—Bacon & Thomas

[57] ABSTRACT

A container module includes a closed hollow body. A first tube has an upper end disposed outside of the closed hollow body and communicating with the waste supply and a lower end mounted in the closed hollow body. A second tube has an upper end disposed outside of the closed hollow body and communicating with the pump and a lower end mounted in the closed hollow body. The lower end of the second tube is at a level higher than that of the lower end of the first tube.

1 Claim, 2 Drawing Sheets

CONTAINER MODULE FOR DRAWING AND RECEIVING FLUID WASTE

BACKGROUND OF THE INVENTION

1. Field of Invention

The present invention relates to a container module, and more particularly to a container module for drawing and receiving fluid waste therein.

2. Related Prior Art

Usually, people have to exchange waste fluid such as engine oil by themselves from an oil pan (or sump) of an automobile such that a device is required for drawing and receiving engine oil therein from the oil pan when maintenance of the automobile is performed.

SUMMARY OF THE INVENTION

The primary objective of the present invention is to provide a container module for drawing and receiving fluid waste such as waste engine oil therein.

In accordance with one aspect of the present invention, there is provided a container module for drawing and receiving fluid waste therein from a waste supply by means of a pump. The container module comprises a closed hollow body. A first tube includes an upper end disposed outside of the closed hollow body and communicating with the waste supply and a lower end mounted in the closed hollow body. A second tube includes an upper end disposed outside of the closed hollow body and communicating with the pump and a lower end mounted in the closed hollow body. The lower end of the second tube is at a level higher than that of the lower end of the first tube.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
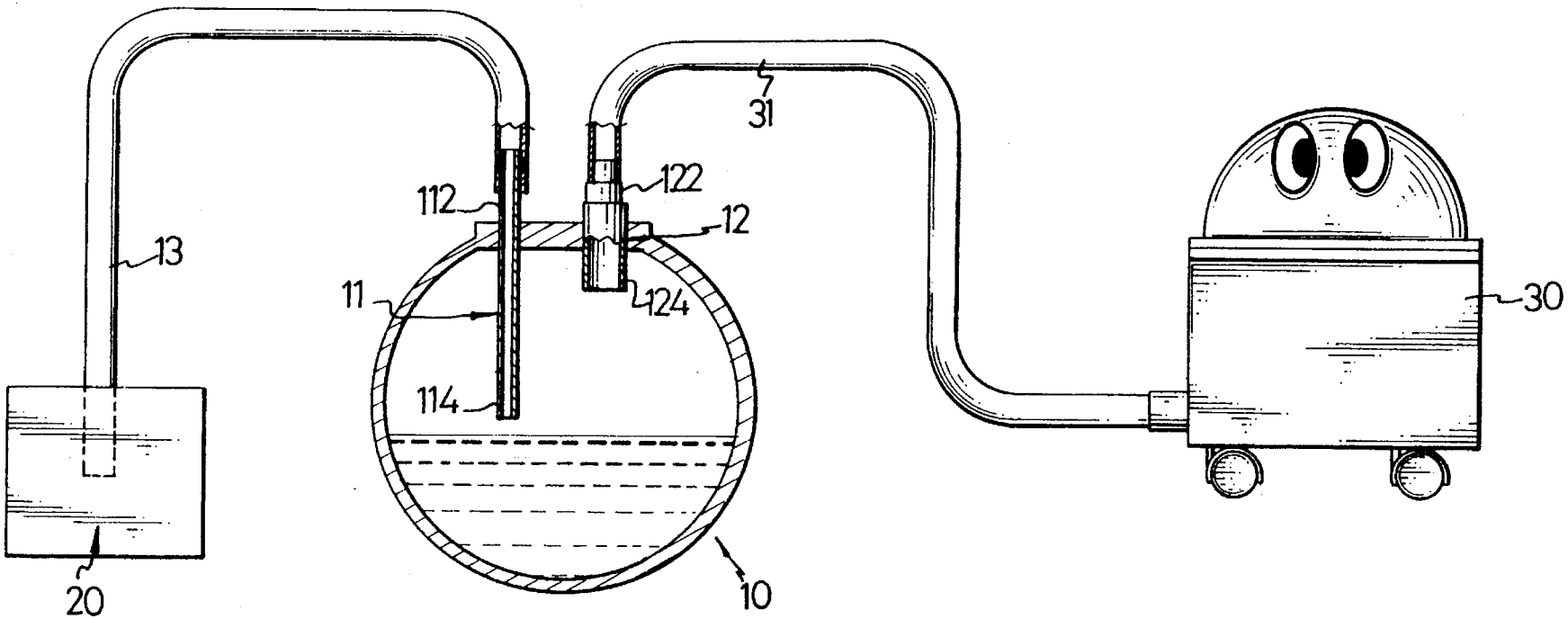
FIG. 1 is a front plan cross-sectional assembly view of a container module in accordance with the present invention.

Referring to the drawings, and initially to FIG. 1, a container module in accordance with the present invention is provided for drawing and receiving fluid waste such as waste engine oil therein from a waste supply 20 by means of a pump 30. The container module comprises a closed hollow body 10 with a configuration of a sphere.

A first tube 11 includes an upper end 112 disposed outside of the closed hollow body 10 and communicating with the waste supply 20 by means of a conduit 13 and a lower end 114 mounted in the closed hollow body 10. A second tube 12 includes an upper end 122 disposed outside of the closed hollow body 10 and communicating with the pump 30 by means of a conduit 31 and a lower end 124 mounted in the closed hollow body 10. It is to be noted that lower end 124 of the second tube 12 is at a level higher than that of the lower end 114 of the first tube 11.

In operation, the fluid waste such as waste engine oil is contained in the waste supply 20 such as an oil pan (or sump). The conduit 13 is connected with the upper end 112 of the first tube 11 and includes a distal end inserted into the waste supply 20. The conduit 31 is connected with the upper end 122 of the second tube 12 and includes a distal end connected to the pump 30. Preferably, the upper end 122 of the second tube 12 is adapted to be formed of a plurality of protrusions (not labeled) in a stepped manner so as to be suitable for the conduit 31 with different dimensions.

When the pump 30 is actuated to draw air away from the closed hollow body 10 to surroundings, thereby forming a negative pressure status in the closed hollow body 10, the waste fluid is driven to displace from the waste supply 20 into the closed hollow body 10 via the conduit 13 and the first tube 11 so as to drain the waste fluid contained in the waste supply 20.

The quantity of the waste fluid received in the closed hollow body 10 is successively increased until a level of the waste fluid reaches that of the lower end 114 of the first tube 11. Then, the waste fluid in the closed hollow body 10 can be taken away with the conduits 13 and 31 being removed.

The lower end 124 of the second tube 12 is at a level higher than that of the lower end 114 of the first tube 11 such that the waste fluid in the closed hollow body 10 is not able to reach the lower end 124 of the second tube 12, so preventing the waste fluid from entering into the pump 30 through the second tube 12 and the conduit 31 such that the pump 30 is able to operate normally so as to continuously drain the air in the closed hollow body 10 to surroundings, thereby always retaining the closed hollow body 10 in a vacuum status or in a negative pressure phase.

Preferably, the distal end of the conduit 31 can be directly linked to a dust cleaner which is able to drain air in the closed hollow body 10 to surroundings.

Figure 2:
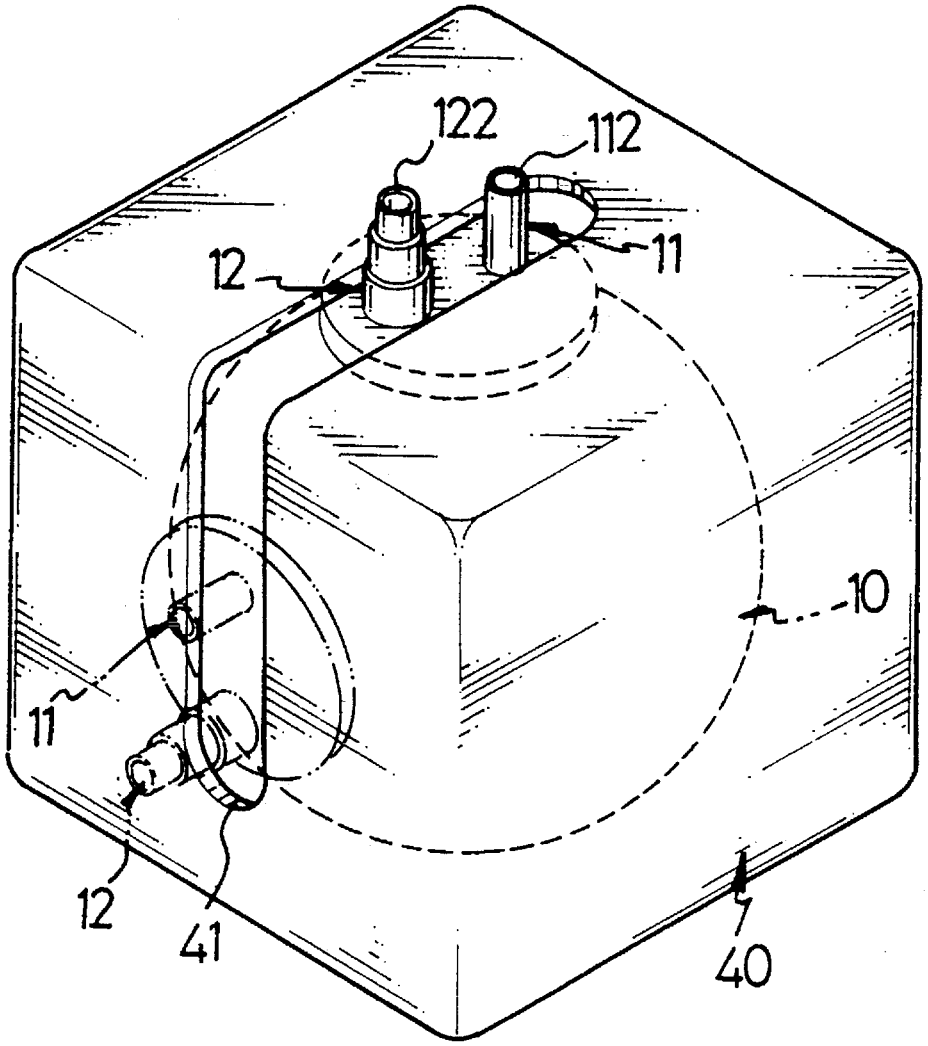
FIG. 2 is a perspective view showing the container module retained in a casing.

Referring to FIG. 2, the closed hollow body 10 is stably received in a rectangular casing 40 which has a slot 41 defined therein. The upper ends 112 and 122 of the first and second tubes 11 and 12 respectively extend through the slot 41 of the casing 40. By such an arrangement, the closed hollow body 10 is able to rotate in the casing 40 with the upper ends 112 and 122 of the first and second tubes 11 and 12 being displaceable and guided along the slot 41 thereof, thereby facilitating the waste fluid contained in the closed hollow body 10 to tip therefrom as shown in phantom lines.

It should be clear to those skilled in the art that further embodiments of the present invention may be made without departing from the teachings of the present invention.

I claim:

1. A container module for drawing and receiving fluid waste therein from a waste supply by means of a pump, said container module comprising; a closed hollow body having a spherical configuration a first tube having a first upper end disposed outside of said closed hollow body and adapted to communicate with said waste supply and a first lower end mounted in said closed hollow body; a second tube having a second upper end disposed outside of said closed hollow body and adapted to communicate with said pump and a second lower end mounted in said closed hollow body, the second lower end of said second tube is at a level higher than that of the first lower end of said first tube; and, a casing mounted around said closed hollow body for receiving said closed hollow body therein, said casing having a slot extending along a portion of a periphery of said casing, the first and second upper ends extending through said slot.

* * * * *